US012024358B2

(12) United States Patent
Shepherd et al.

(10) Patent No.: US 12,024,358 B2
(45) Date of Patent: Jul. 2, 2024

(54) STACKABLE BULK FLUID STORAGE CONTAINER

(71) Applicant: SANDBOX LOGISTICS, LLC, Houston, TX (US)

(72) Inventors: Justin Shepherd, Houston, TX (US); Akshay Hingwe, Katy, TX (US); Chad Trueheart, League City, TX (US); Derek Ussery, The Woodlands, TX (US); Chris Witting, New Braunfels, TX (US); Daniel Miers, Tiki Island, TX (US)

(73) Assignee: SANDBOX ENTERPRISES, LLC, Katy, TX (US)

( * ) Notice: Subject to any disclaimer, the term of this patent is extended or adjusted under 35 U.S.C. 154(b) by 800 days.

(21) Appl. No.: 16/802,598

(22) Filed: Feb. 27, 2020

(65) Prior Publication Data

US 2021/0198031 A1 Jul. 1, 2021

Related U.S. Application Data

(60) Provisional application No. 62/822,446, filed on Mar. 22, 2019.

(51) Int. Cl.
*B65D 88/54* (2006.01)
*B65D 88/02* (2006.01)
(Continued)

(52) U.S. Cl.
CPC ..... *B65D 88/54* (2013.01); *B65D 88/022* (2013.01); *B65D 88/128* (2013.01); *B65D 88/52* (2013.01);
(Continued)

(58) Field of Classification Search
CPC ..... B65D 88/022; B65D 90/10; B65D 53/06; F17C 1/02; F16B 13/085; F16B 13/0866; F16B 2/243
(Continued)

(56) References Cited

U.S. PATENT DOCUMENTS 4,599,040 A 7/1986 Rasmussen
4,679,979 A 7/1987 Rasmussen
(Continued)

FOREIGN PATENT DOCUMENTS

CA 2889959 11/2015
DE 20320972 U1 9/2005
(Continued)

OTHER PUBLICATIONS

International Preliminary Report on Patentability issued in related International Application No. PCT/US2021/019223, dated Sep. 9, 2022 (12 pages).

*Primary Examiner* — Anthony D Stashick
*Assistant Examiner* — Raven Collins
(74) *Attorney, Agent, or Firm* — Osha Bergman Watanabe & Burton LLP

(57) ABSTRACT

A bulk fluid storage container includes a frame assembly having a lower rectangular frame, first and second wheel assemblies extending from opposite ends of the lower rectangular frame, and an upper rectangular frame member arranged in spaced relation to the lower rectangular frame member by a plurality of vertically extending posts. The bulk fluid storage container also includes a fluid storage vessel having first and second end walls held in spaced relation by first and second side walls, a top wall and a bottom wall, which defines a fluid storage volume. A baffle assembly having a plurality of baffle plates is disposed in a space relationship in the fluid storage volume. The frame
(Continued)

assembly provides an exoskeletal structure which surrounds the fluid storage vessel and is configured to support a second bulk fluid storage container in a vertically stacked relationship.

16 Claims, 9 Drawing Sheets

(51) Int. Cl.

| | |
|---|---|
| ***B65D 88/12*** | (2006.01) |
| ***B65D 88/52*** | (2006.01) |
| ***B65D 90/00*** | (2006.01) |
| ***B65D 90/10*** | (2006.01) |
| ***B65D 90/16*** | (2006.01) |
| ***B65D 90/18*** | (2006.01) |
| ***B65D 90/34*** | (2006.01) |
| ***B65D 90/48*** | (2006.01) |
| ***B65D 90/52*** | (2006.01) |
| ***B65D 90/62*** | (2006.01) |

(52) U.S. Cl.
CPC ..... *B65D 90/0033* (2013.01); *B65D 90/10* (2013.01); *B65D 90/16* (2013.01); *B65D 90/18* (2013.01); *B65D 90/34* (2013.01); *B65D 90/48* (2013.01); *B65D 90/52* (2013.01); *B65D 90/623* (2013.01); *B65D 88/027* (2013.01); *B65D 2588/12* (2013.01)

(58) Field of Classification Search
USPC ..... 220/563
See application file for complete search history.

(56) References Cited

U.S. PATENT DOCUMENTS

| | | | | |
|---|---|---|---|---|
| 4,690,608 | A | 9/1987 | Rasmussen | |
| 5,534,138 | A * | 7/1996 | Coale | B01D 17/0217 210/522 |
| 5,582,311 | A | 12/1996 | Bartenstein | |
| 5,624,049 | A | 4/1997 | Kovash et al. | |
| 5,678,978 | A | 10/1997 | Markham | |
| 5,938,065 | A | 8/1999 | De Vivo et al. | |
| D417,171 | S | 11/1999 | Satterfield et al. | |
| 6,152,492 | A | 11/2000 | Markham et al. | |
| 6,173,991 | B1 | 1/2001 | Piona et al. | |
| 6,354,787 | B1 | 3/2002 | O'Daniel | |
| 6,364,153 | B1 | 4/2002 | Petzitillo, Jr. et al. | |
| D557,178 | S | 12/2007 | Petzitillo, Jr. et al. | |
| 7,736,106 | B2 | 6/2010 | Talbot et al. | |
| 7,762,588 | B2 | 7/2010 | Markham | |
| 7,780,383 | B2 | 8/2010 | Brescia | |
| 7,789,256 | B2 | 9/2010 | Petzitillo, Jr. et al. | |
| 7,815,222 | B2 | 10/2010 | Markham | |
| 7,997,441 | B2 | 8/2011 | Marcel | |
| 8,261,930 | B2 | 9/2012 | Satterfield et al. | |
| D678,127 | S | 3/2013 | Markham | |
| 8,523,233 | B2 | 9/2013 | Markham | |
| 9,150,349 | B2 | 10/2015 | Hall et al. | |
| 9,205,883 | B2 | 12/2015 | Bennett et al. | |
| 9,481,513 | B2 | 11/2016 | Warren et al. | |
| D819,778 | S | 6/2018 | Polacek et al. | |
| 10,040,386 | B2 | 8/2018 | Trueman | |
| 10,538,382 | B2 | 1/2020 | Petzitillo, Jr. | |
| 2009/0242576 | A1 * | 10/2009 | Marcel | B65D 90/0033 220/647 |
| 2010/0013206 | A1 | 1/2010 | Markham | |
| 2010/0013207 | A1 | 1/2010 | Markham | |
| 2010/0320727 | A1 * | 12/2010 | Haut | B65D 88/128 280/423.1 |
| 2011/0121003 | A1 * | 5/2011 | Moir | B65D 88/128 220/592 |
| 2012/0305553 | A1 | 12/2012 | Brotzell et al. | |
| 2013/0084159 | A1 | 4/2013 | Warren et al. | |
| 2015/0144625 | A1 * | 5/2015 | Banik | B65D 11/1833 220/7 |
| 2015/0233745 | A1 | 8/2015 | Kumar | |
| 2015/0369647 | A1 | 12/2015 | Kumar et al. | |
| 2016/0311376 | A1 | 10/2016 | Dokter et al. | |
| 2016/0318707 | A1 | 11/2016 | Markham | |
| 2017/0361754 | A1 | 12/2017 | Trueman | |
| 2018/0241291 | A1 * | 8/2018 | Mou | A01D 34/78 |
| 2018/0251291 | A1 | 9/2018 | Markham | |
| 2018/0252083 | A1 | 9/2018 | Hardin et al. | |
| 2018/0290826 | A1 | 10/2018 | Polacek et al. | |
| 2018/0305141 | A1 | 10/2018 | Markham | |
| 2019/0061597 | A1 | 2/2019 | Markham | |

FOREIGN PATENT DOCUMENTS

| | | | |
|---|---|---|---|
| WO | 2006009511 | A1 | 1/2006 |
| WO | 2014114197 | A1 | 7/2014 |

* cited by examiner

STACKABLE BULK FLUID STORAGE CONTAINER

TECHNICAL FIELD

The present disclosure relates generally to a fluid storage container, and more particularly relates to a stackable bulk fluid storage tank for the transport and storage of fluids used in the oil and gas industry, over the life cycle of a well including drilling, completions, production, maintenance, and/or decommissioning as well as other applicable industries that require an onsite inventory of fluid materials.

BACKGROUND

This section provides background information related to the present disclosure which is not necessarily prior art.

Hydraulic fracturing is a well stimulation technique in which rock is fractured by a pressurized liquid. The process involves the high-pressure injection of a 'fracking fluid' (primarily water, containing sand or other proppants suspended with the aid of thickening agents) into a wellbore to create cracks in the deep-rock formations through which natural gas, petroleum, and brine will flow more freely. When the hydraulic pressure is removed from the well, small grains of hydraulic fracturing proppants, such as sand or aluminum oxide, hold the fractures open.

The hydraulic fracturing process requires the transportation and storage of various resources at the well-site which is consumed during the fracturing process. Recent efforts have focused on improved logistics including containerization solutions primarily directed to storage, handling and well-site delivery of proppant. Little attention has been paid to improved logistics relating to the storage, handling and well-site delivery of fluids used in the hydraulic fracturing process. Traditionally, water logistics has been accomplished with the use of a series of transport/vacuum trucks to move water to and fill storage tanks, i.e., frac tanks. These trucks off load water into these storage tanks at the desired location. These conventional solutions for water have used vacuum boxes that require a relatively heavy gauge container, which increase the weight of the storage tank thereby limiting the volume of fluids that may be transported and stored in compliance with federal and state transportation regulations. Additionally, vacuum boxes typically have a tailgate arranged at the back of the box. Oftentimes the tailgate is not 100% sealable resulting in a risk of spillage and loss of stored fluids. Likewise, conventional solutions for hydraulic fracturing chemicals typically include totes that are difficult to manage logistically due to their low capacity.

In addition to hydraulic fracturing, wastewater and freshwater are used throughout the oil and gas production cycle. Specifically, wastewater is produced alongside oil and gas and often needs to be transported to a disposal, or recycling site. Additionally, freshwater is used throughout several well servicing jobs during the life of the oil well. Trucking in both processes is still prevalent, but little attention has been paid to improved logistics.

Accordingly, there is a need to provide a suitable, cost effective solution for the transportation, set-up and storage of fluids used in a variety of industrial applications including the oil and gas industry.

SUMMARY

The systems and methods disclosed herein enable the transportation, set-up and storage of bulk fluids at a well-site or similar location with one single move, in which the storage tank is deliverable to and/or from the location full of fluid. In one aspect of the present disclosure, a bulk fluid storage container includes a fluid storage vessel defining a fluid storage volume for storing a fluid and a frame assembly which surrounds the fluid storage vessel, wherein the fluid storage volume is maintained at an atmospheric pressure. The fluid storage vessel includes a top port formed in the fluid storage vessel for filling the fluid storage volume, one or more upper ports formed in the fluid storage vessel for venting the fluid storage volume and one or more lower ports formed in the fluid storage vessel for draining the fluid storage volume. This aspect has the effect that the bulk fluid storage container is lighter than conventional vacuum boxes such that the fluid storage vessel has a larger fluid storage capacity for a given weight limit. Moreover, this aspect has the effect that the bulk fluid storage container may be delivered to a well-site on a transport vehicle, unloaded and staged for use at the well-site, thus preventing demurrage time of those vehicles as well as the initial setup time associated with conventional frac tanks.

According to another aspect of the present disclosure, the frame assembly provides an exoskeletal structure configured to support a second bulk fluid storage container in a vertically stacked relationship. This aspect has the effect of significantly increasing the volume of fluid that may be stored within a prescribed footprint at the well-site. For example, a pair of vertically stacked bulk fluid storage containers effectively doubles the fluid storage capacity for a given area at the well-site.

According to another aspect of the present disclosure, the frame assembly includes an upper rectangular frame member and a lower rectangular frame member, wherein the upper rectangular frame member is arranged in spaced relation to the lower rectangular frame member by a plurality of vertically extending posts. The lower rectangular frame may include tubular cross members extending between longitudinal rails. These aspects have the effect of enclosing and protecting the fluid storage vessel such that it may be readily transported on conventional vehicles such as lift trucks, cranes, flatbed trailers, rail cars, and the like.

According to another aspect of the present disclosure, a stackable fluid storage container includes a truncated or tapered section in a front-end region. The fluid storage container may include a set of diverging channels on a top wall of the tapered section. These aspects have the effect of facilitating the loading and stacking of the second storage container onto the first storage container in a vertically stacked relationship.

According to another aspect of the present disclosure, a stackable fluid storage container having a frame assembly with longitudinal guides arranged on the upper rectangular frame and longitudinal rails arranged on the lower rectangular frame, wherein the longitudinal rails on a first bulk fluid storage container are configured to cooperate with the longitudinal guides on a second bulk fluid storage container. This aspect has the effect of aligning the first and second storage containers in a vertically stacked relationship.

According to another aspect of the present disclosure, a fluid storage container includes a vent pipe coupled to the upper port and in fluid communication with the fluid storage volume. This aspect has the effect of maintaining atmospheric pressure within the fluid storage volume.

According to another aspect of the present disclosure, a fluid storage container includes a vent header coupled between the upper ports a first storage container and a second storage container stacked on top of the first storage container. In another aspect of the present disclosure, the vent header may be diagonally oriented between the upper ports on the first and second storage containers. These aspects have the effect of maintaining atmospheric pressure within the fluid storage volumes of the first and second storage containers.

According to another aspect of the present disclosure, the frame assembly may include a first wheel assembly extending from a first end of the frame assembly and a second wheel assembly extending from the second end of the frame assembly. The fluid storage container may include a winch coupling formed in a recess of the fluid storage vessel and having a coupling plate with a loop or catch configured to receive a hook on a winch cable. These aspects have the effect that the bulk fluid storage container is configured to be loaded and unloaded with a stinger tail roll off truck.

According to another aspect of the present disclosure, the fluid storage vessel includes an internal baffle assembly, which is vertically oriented in the fluid storage volume. This aspect has the effect of reducing fluid sloshing and stabilizing the bulk fluid storage container when it is transported in a partially or completely filled condition.

According to another aspect of the present disclosure, the fluid storage vessel is divided with one or more internal baffle plates. This aspect has the effect of separating the fluid storage volume into separate sections for storing diverse fluids.

According to another aspect of the present disclosure, the fluid storage container includes a level detection device in communication with the fluid storage volume. This aspect has the effect of readily indicating the fluid level within the fluid storage volume, or in other words the state of fill for the fluid storage container.

BRIEF DESCRIPTION OF THE DRAWINGS

The drawings described herein are for illustrative purposes only of selected embodiments and not all possible implementations and are not intended to limit the scope of the present disclosure.

Corresponding reference numerals indicate corresponding parts throughout the several views of the drawings.

DETAILED DESCRIPTION

Figure 1:
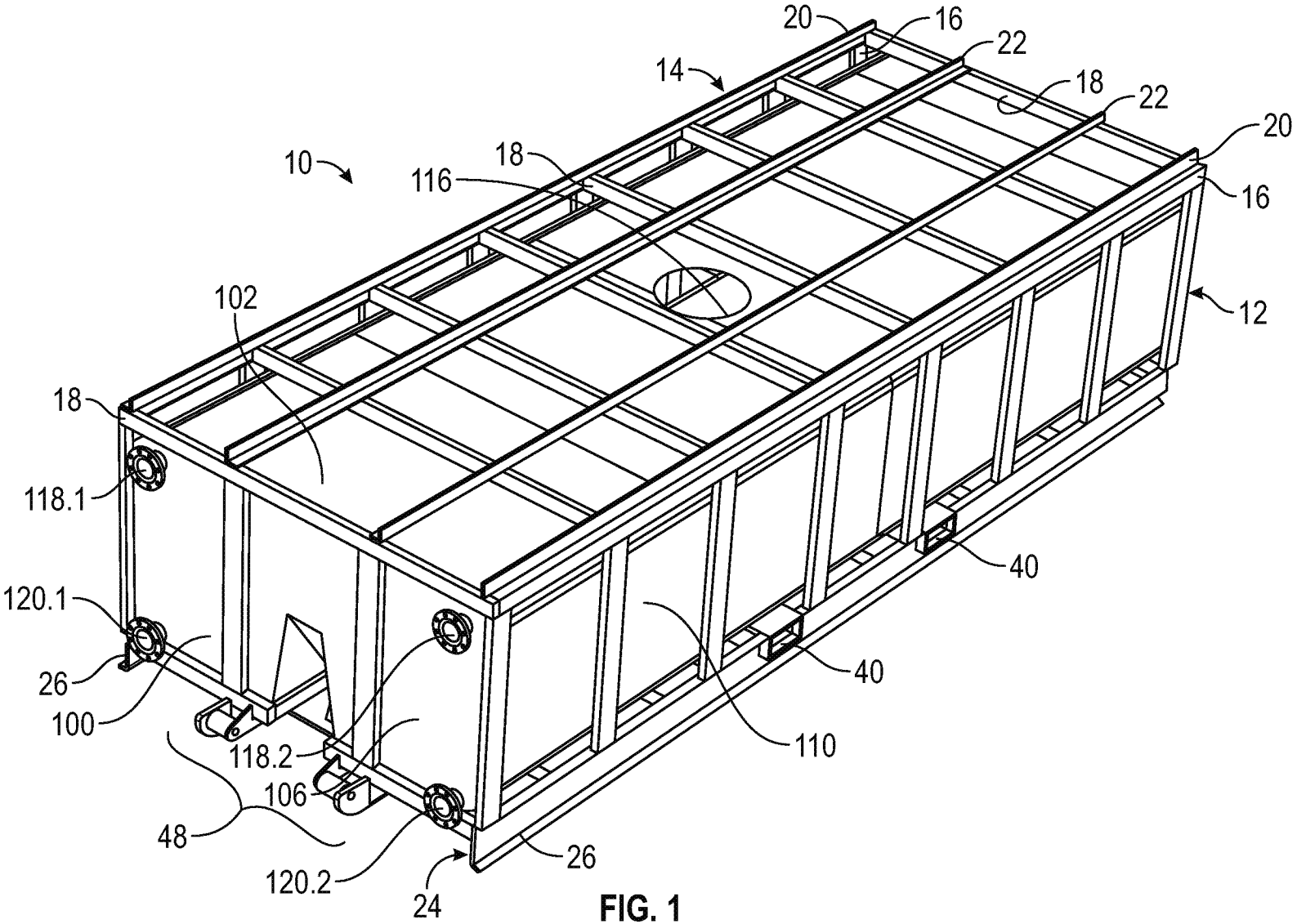
FIG. 1 is an upper front perspective view of a stackable bulk fluid storage container in accordance with an embodiment of the present disclosure.

The following detailed description is merely exemplary in nature and is not intended to limit the invention or the application and uses of the invention. Furthermore, there is no intention to be bound by any theory presented in the preceding background or the following detailed description.

In accordance with the present disclosure, a stackable bulk fluid storage container is described and illustrated which facilitates the storage and transport of fluid material such as water and/or other chemicals used at a well-site, construction site or other similar industrial sites. As used herein, the term "fluid material" or simply "fluid" may include liquid, semi-liquid and/or semi-solid materials. A bulk fluid storage container in accordance with the present disclosure is configured to be transported on a roll-off or winch truck. By way of non-limiting examples, a bulk fluid storage container in accordance with the present disclosure may be used to transport and store various fluid materials such as water or other oil field and construction chemicals. Bulk fluid storage containers in accordance with the present disclosure are detachable from the transport vehicle for facilitating resources when transporting containers to and from the site, as well as handling and use of the containers at the site. In this regard, a bulk fluid storage container in accordance with the present disclosure is configured to be handled with a pallet truck or forklift for readily placing the container at or around the well site. A bulk fluid storage container in accordance with the present disclosure is also configured to be stackable on top of another and fluidly couplable to increase the volume storage capacity without increasing the overall footprint required at the site. Additionally, the bulk fluid storage container, in accordance with the present disclosure, is designed to be loaded onto a truck with full volume capacity while continuing to meet all DOT restrictions. One skilled in the art should understand that bulk fluid storage containers in accordance with the present disclosure may have utility in industries other than the oil & gas industry where onsite fluid transport and storage is needed such as construction sites, disaster relief sites, wastewater or chemical water treatment sites, environmental remediation sites, airports or shipyards, and agriculture or farming sites.

With reference to FIGS. 1-9, an embodiment of a stackable bulk fluid storage container 10 includes a frame assembly 12 surrounding, supporting and reinforcing a fluid storage vessel 100. With specific reference to FIGS. 1 and 3, the components of the frame assembly 12 includes a rectangular upper frame 14 formed with a pair of headers 16 extending longitudinally on top of the fluid storage vessel 100. A plurality of transverse members 18 extend between the headers 16. A pair of lateral guides 20 and a pair of medial guides 22 are longitudinally supported on and secured to the rectangular upper frame 14.

The frame assembly 12 also includes a rectangular lower frame 24 formed with a pair of lateral rails 26 and a pair of medial rails 28 extending longitudinally beneath the fluid storage vessel 100. A pair of transverse beams 30 are secured to the ends of the lateral beams 26 and extend therebetween. A plurality of joists 32 also extend between the pair of lateral rails 26 and are supported on the pair of medial rails 28. The upper and lower frame members 14, 24 are supported in a spaced relationship by posts 34 extending between the headers 16 and the lateral rails 26 and between the transverse member 18 and transverse beams 30 to form a generally rectangular cuboid frame structure.

In the embodiment illustrated in FIGS. 1-4, the lateral rails 26 and the joists 32 are formed as channel steel stock having a generally C-shaped cross-section; the lateral and medial guides 20, 22 are formed as angle-iron steel stock having a generally L-shaped cross-section; and the headers 16, 18, the medial rails 28, the transverse beams 30 and the posts 34 are formed with tubular steel stock have a generally rectangular cross-section.

The bulk fluid storage container 10, and more specifically the frame assembly 12 includes a pair of tubular cross-members 40 (best seen in FIG. 3) configured to receive the tines of a lifting fork such as found on a pallet jack or forklift truck. In particular, the lateral rails 26 have a pair of rectangular apertures 36 formed in the side wall, and the medial rails 28 have a pair of notches 38 formed therein. The tubular cross-members 40 are aligned with the apertures 36 and notches 38 and welded or otherwise secured thereto, thus forming forklift pockets to receive the tines of a lifting fork.

Figure 2:
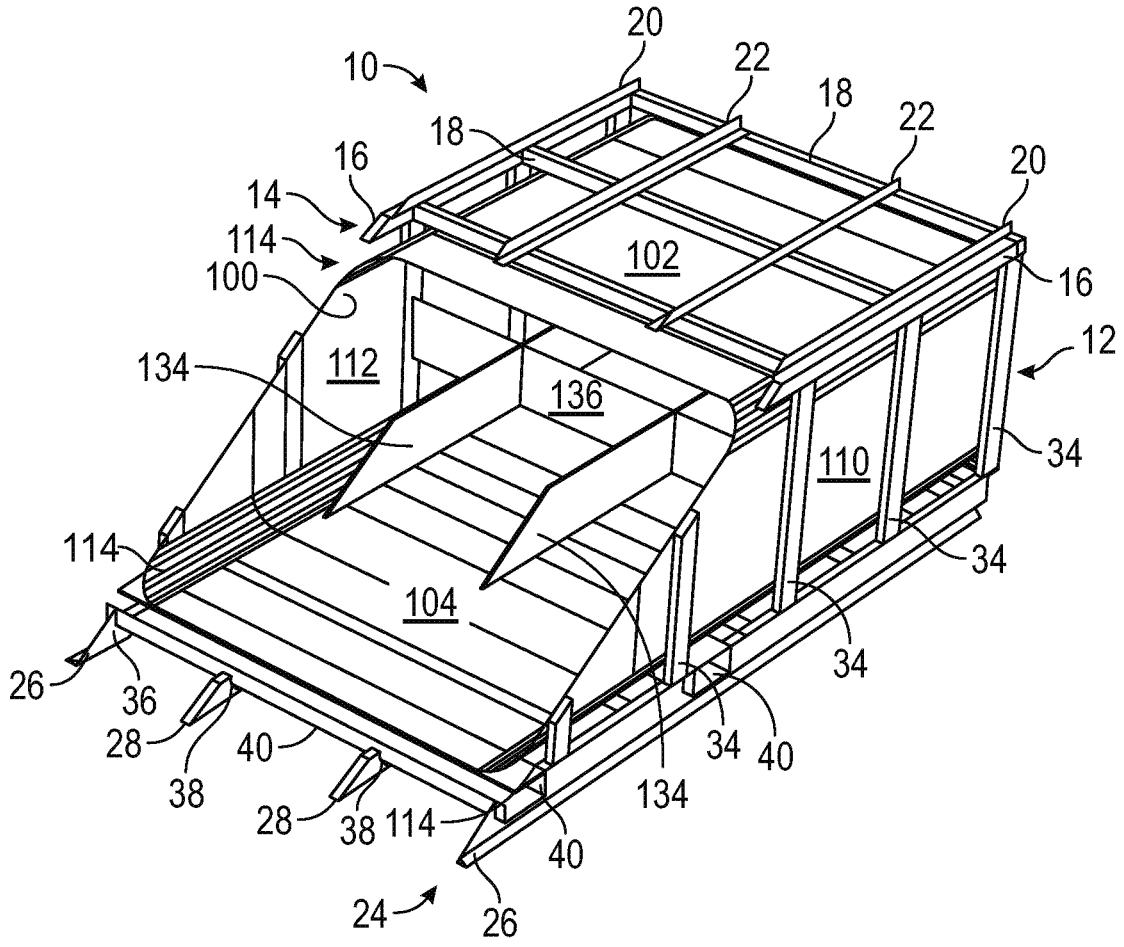
FIG. 2 a cutaway view of the storage container shown in FIG. 1.
Figure 4:
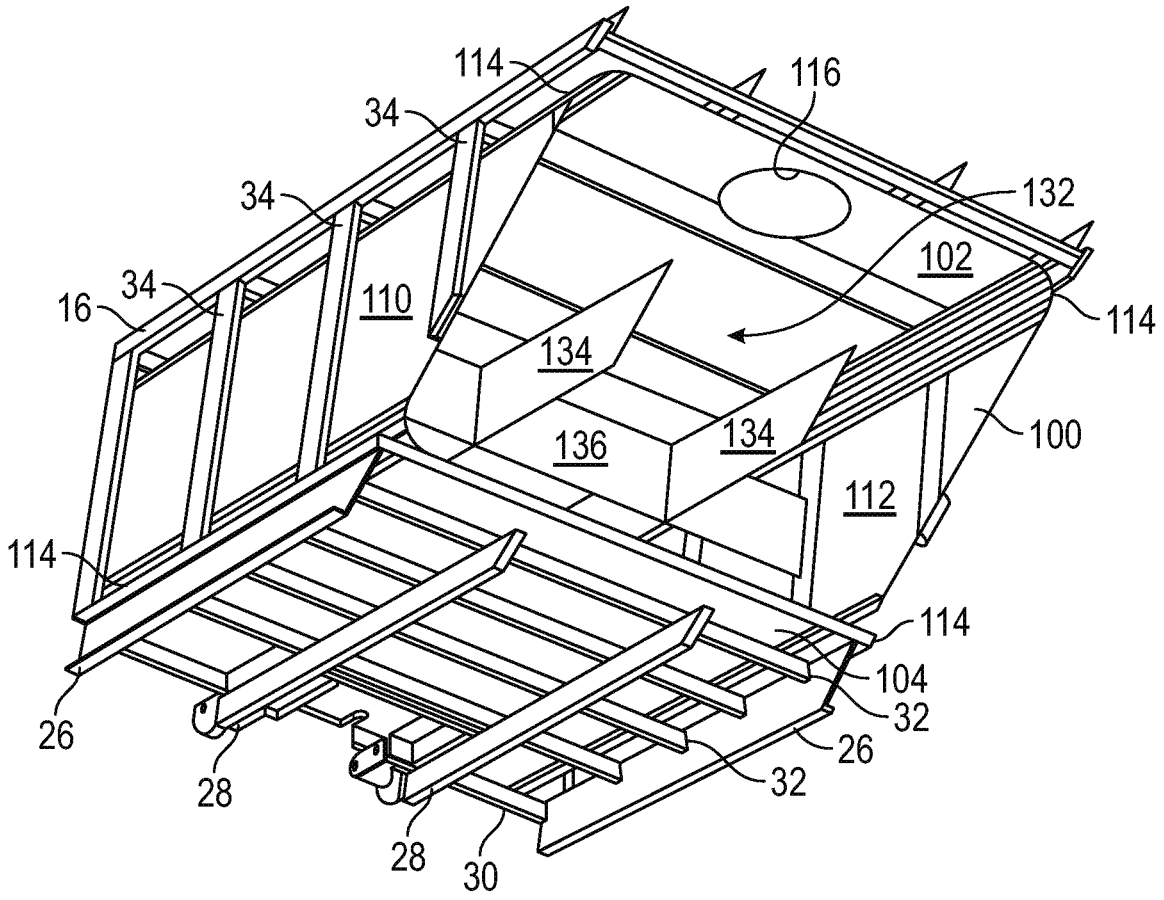
FIG. 4 is a cutaway view of the storage container shown in FIG. 3.

The fluid storage vessel 100 is sized to fit within and secured to the frame assembly 12. In this way, the frame assembly 12 provides an exoskeletal structure for protecting and supporting the fluid storage vessel 100. The fluid storage vessel 100 include top and bottom walls 102, 104, front and rear end walls 106, 108 and left and right side walls 110, 112. As best seen in FIGS. 2 and 4, the top wall 102 and the bottom wall 104 join the side walls 110, 112 at a rounded corner sections 114. The top wall 102 of the fluid storage vessel 100 is provided with a fill port 116, which may be configured with a flanged connection and/or cover plate (not shown). The front and rear end walls 106, 108 of the fluid storage vessel 100 are provided with upper flanged ports 118.1, 118.2, 118.3, 118.4 (collectively 118) and lower flanged ports 120.1, 120.2, 120.3, 120.4 (collectively 120), which may be configured to provide venting and/or draining functions of the fluid storage vessel 100. These flanged ports 116, 118, 120, 122 may also be used to fluidly couple fluid storage vessels 100 positioned adjacent to one another such as in a stacked relationship.

Figure 8:
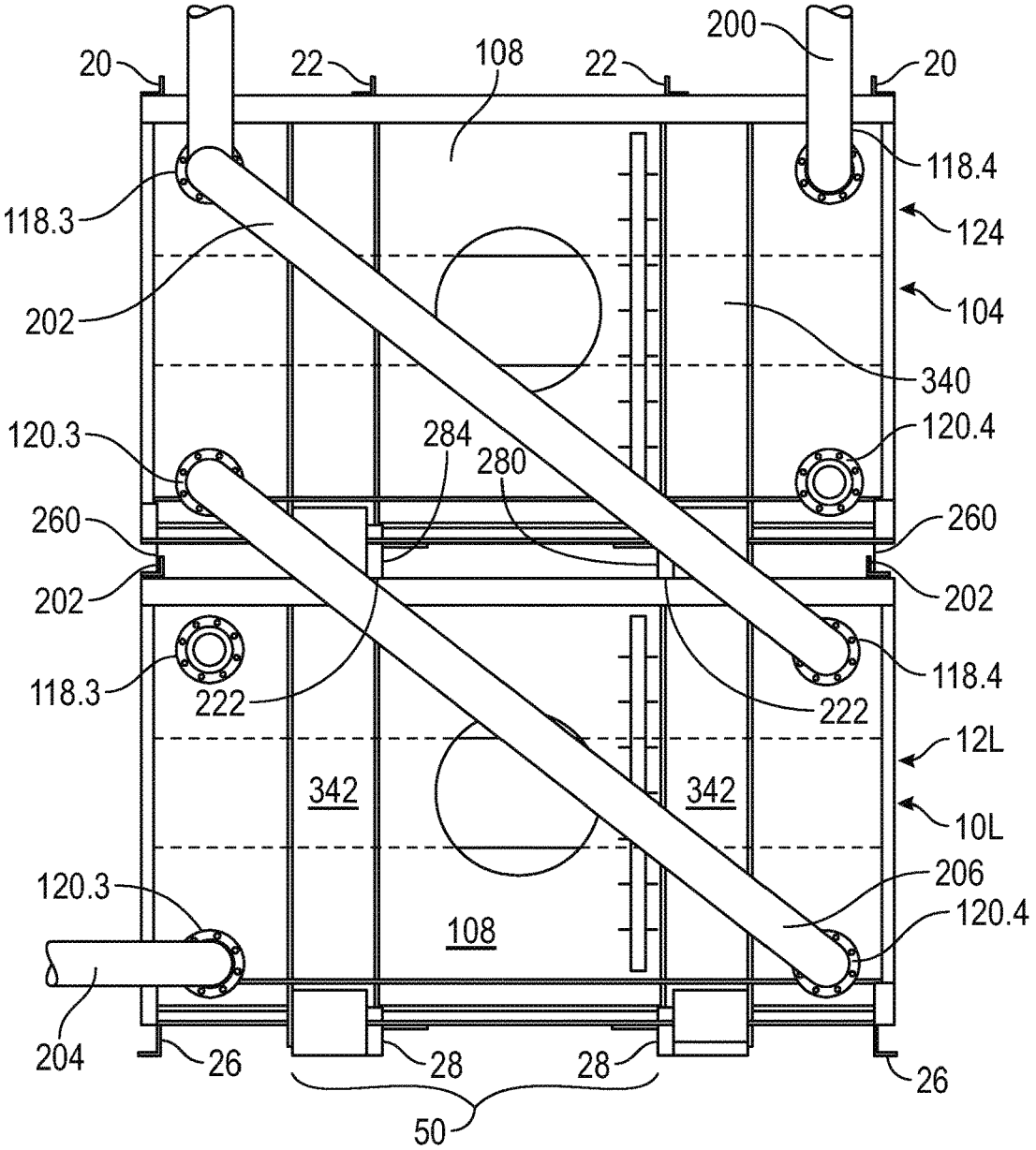
FIG. 8 is a rear end view showing a pair of bulk fluid storage containers arranged in a stacked relationship with interconnecting piping.

For example, as illustrated in FIG. 8, a vent pipe 200 may be fluidly coupled to the fluid storage vessel 100 at upper flanged port 118.4. When the fluid storage containers are arranged in a vertically stacked relationship, a vent header 202 may be fluidly coupled between an upper flanged port 118.4 of the lower fluid storage container 10L and an upper flanged port 118.3 of the upper fluid storage container 10U. Similarly, a drainpipe 204 may be fluidly coupled to the fluid storage vessel 100 at lower flanged port 120.3. When the fluid storage containers are arranged in a vertically stacked relationship, a drain header 206 may be fluidly coupled between a lower flanged port 120.3 of the upper fluid storage container 10U and a lower flanged port 120.4 of the lower fluid storage container 10. One skilled in the art will recognize that the bulk fluid storage containers may be fluidly coupled to vents and drains in other similar manners in accordance with the present disclosure.

Figure 3:
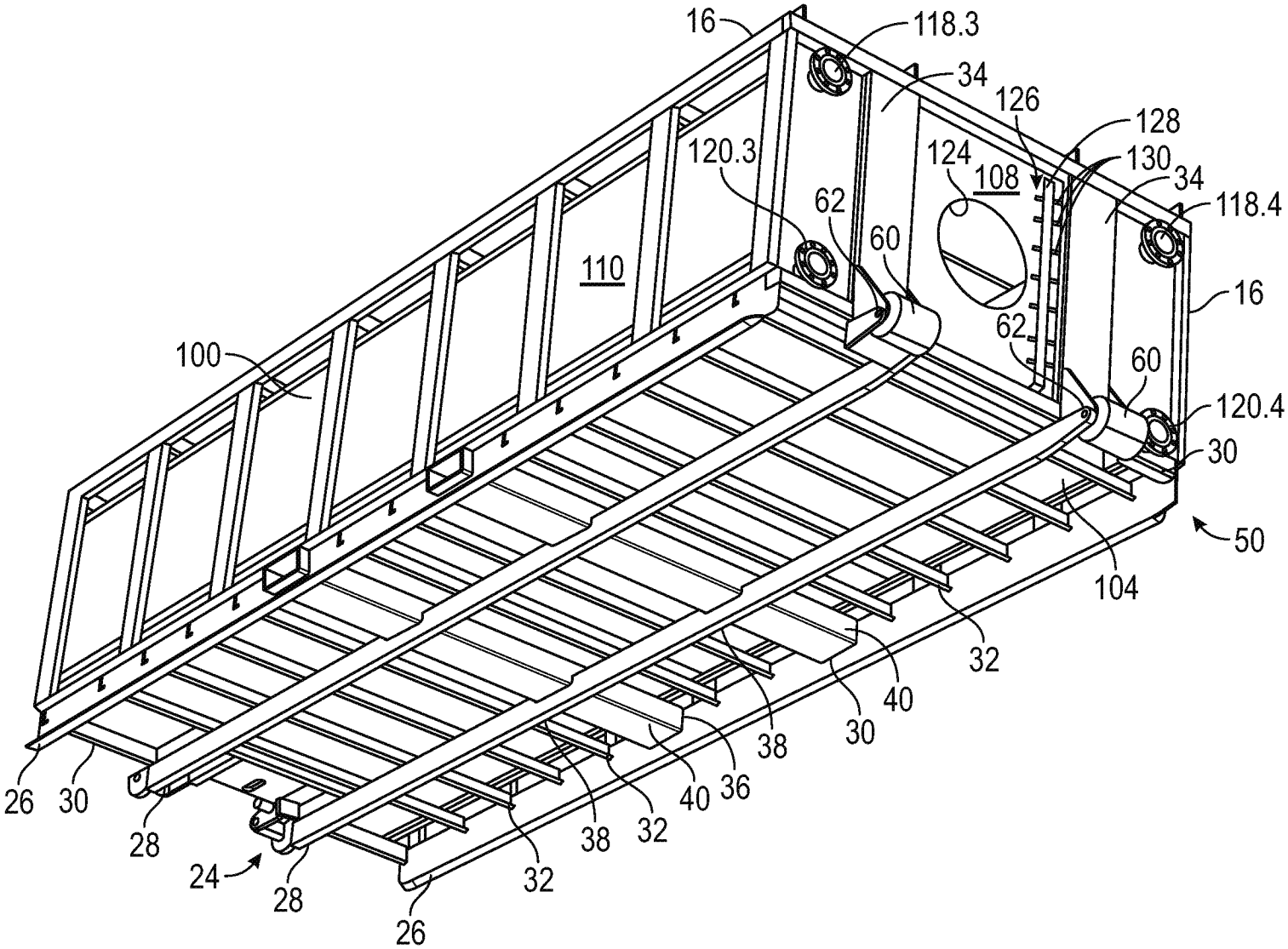
FIG. 3 is a lower rear perspective view of the stackable fluid bulk storage container shown in FIG. 1.

With reference to FIGS. 3 and 8, the rear end wall 108 of the fluid storage vessel 100 also has an access port 124 formed therein, which may be configured with a sealable manway cover (not shown) for accessing an interior volume thereof. As shown in FIG. 3, the rear end wall 108 is also provided with a level detection device 126 to indicate a fluid level within the interior volume of the fluid storage vessel 100. As illustrated herein, the level detection device 126 is a sight glass or translucent window 128 with graduations 130 for detecting the fluid level within the fluid storage vessel 100. There are many physical and application variables that affect the selection of an optimal level detection device including the physical: phase (liquid, solid or slurry), temperature, dielectric constant of medium, density (specific gravity) of medium, agitation (action), acoustical or electrical noise, vibration, mechanical shock, tank or bin size and shape. Other important considerations include price, accuracy, appearance, response rate, ease of calibration or programming, physical size and mounting of the instrument, monitoring or control of continuous or discrete (point) levels. Thus, one skilled in the art should understand that other level sensors or level detection devices may be readily adapted for use with the bulk fluid storage container 10 disclosed herein. By way of non-limiting examples, such level detection devices include optical level switches, capacitance level sensors, ultrasonic level sensors, microwave or radar level sensors, conductive or resistance level sensors and float switch sensors.

With reference now to FIGS. 2 and 4, the fluid storage vessel 100 includes an internal baffle assembly 132 for reducing fluid sloshing when the bulk fluid storage container 10 is moved and/or transported. The baffle assembly 132 includes a plurality of baffle plates disposed within the fluid storage vessel 100 to form a lattice structure. In particular, a pair of first baffle plates 134 are vertically oriented and extend longitudinally within the interior volume of the fluid storage vessel 100. A plurality of second baffle members 136 are also vertically oriented and extend transversely within the interior volume of the fluid storage vessel 100. The first and second baffle plates 134, 136 are interconnected to form the lattice structure. The first and second baffle members 134, 136 may be welded or otherwise secured to wall plates or brackets (not shown) on the front and rear end walls 106, 108 and the left and right side wall 110, 112. It should be noted that the most detrimental effects resulting from fluid sloshing occur when the fluid storage vessel 100 is approximately forty percent full. Accordingly, positioning one or more baffle plates 134, 136 within a range that includes a 40% fill line in the interior volume of the fluid storage vessel 100 has beneficial impact to reduce the detrimental effects resulting from fluid sloshing. In an embodiment, the baffle plates 134, 136 at least extend between the middle third of the interior volume. In other words, the baffle plates 134, 136 at least extend between a 33% fill line and a 66% fill line.

The bulk fluid storage container 10 is preferably sized to be readily stowed and transported on conventional transport vehicles used in commercial roadway systems, railroad systems or fluid supply/discharge stations. In this regard, the bulk fluid storage container is sized to be efficiently loaded onto a flatbed trailer or railcar. For example, the bulk fluid storage container 10 and in particular the frame assembly 12 which surrounds the fluid storage vessel 100 may have an overall length (front to back) of about 23 feet, an overall width (side to side) of about 8.5 feet and an overall height (top to bottom) of about 5.5 feet. In this configuration, the fluid storage vessel 100 has an interior volume having a fluid capacity of about 120 barrels or about 5040 gallons, which in terms of water would weigh about 42,000 lbs.

The bulk fluid storage container 10 is fabricated of suitably rigid materials which has been properly treated for safely storing the desired fluid. For water storage purposes, the frame assembly 12 may be fabricated using welded steel components having a nominal wall thickness of 3/16", and the fluid storage vessel 100 may be fabricated using 3/16" A36 steel plate components which are welded together. The frame assembly 12 and the fluid storage vessel 100 may be prepped using a commercial sand blasting process, then finished using a DTM polyurethane paint.

As noted above, the bulk fluid storage container 10 is configured to be transported on a roll-off or winch truck. In this regard and with reference to FIGS. 5-7, the bulk fluid storage container 10 includes a winch coupling 42. The winch coupling 42 includes a recess 138 formed in the front end wall 106. A coupling plate 44 is secured to the rectangular lower frame 24 between the medial rails 28 and extends transversely across the recess 138. A loop or catch 46 extends from the coupling plate 44 and is configured to receive a hook (not shown) attached at the end of a winch cable from the roll-off truck to assist in the loading and unloading of the bulk storage container on to and off of a roll-off truck.

Figure 5:
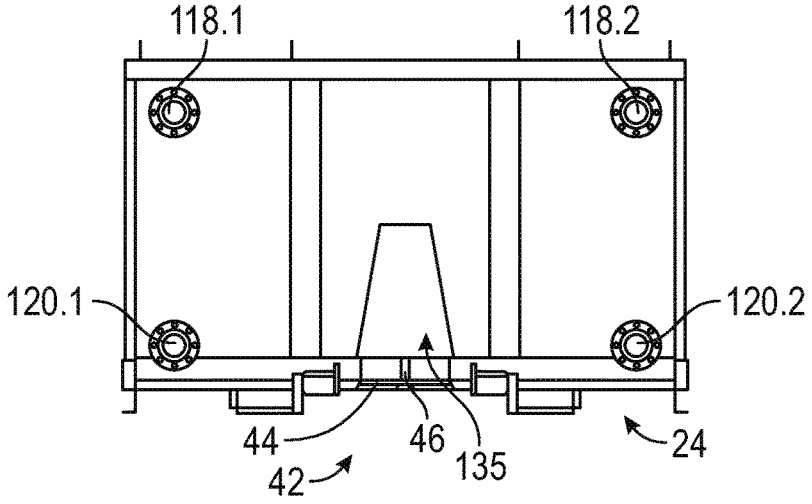
FIG. 5 is a front end view of the bulk fluid storage container shown in FIG. 1.
Figure 6:
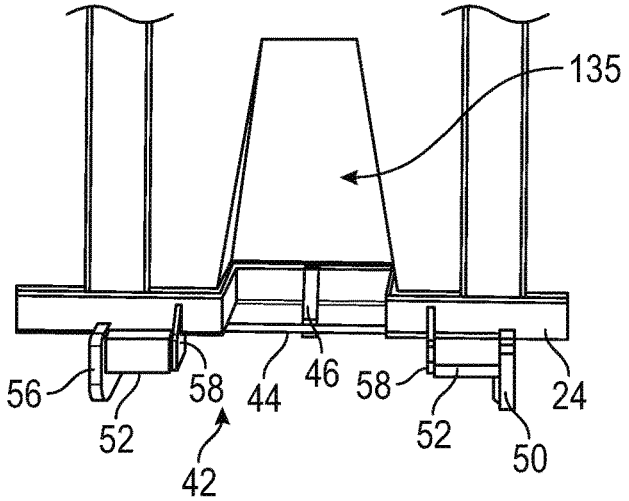
FIG. 6 is a detail showing the front end wall of the bulk fluid storage container shown in FIG. 1.
Figure 7:
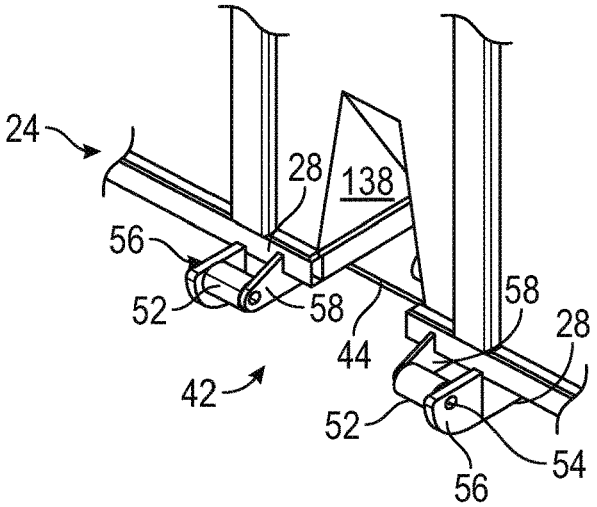
FIG. 7 is a detail showing the front wheel assembly of the bulk storage container shown in FIG. 1.
Figure 9:
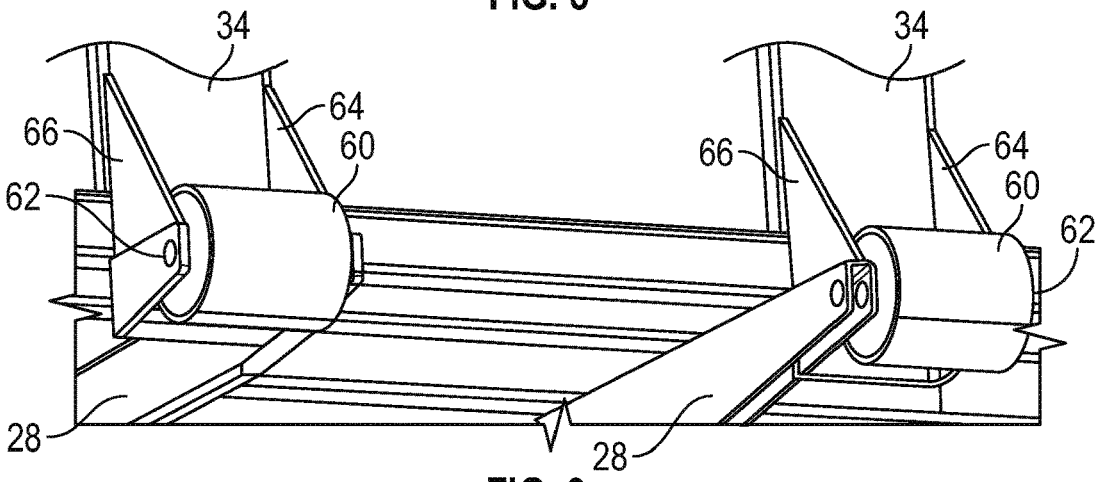
FIG. 9 is a detail showing the rear wheel assembly of the bulk fluid storage container shown in FIG. 1.

With continued reference to FIGS. 5-7, the bulk fluid storage container 10 has a front wheel assembly 48 and a rear wheel assembly 50. The front wheel assembly 48 includes two wheels 52 rotatably supported on an axle 54 spanning between flanges 56, 58 which extend from the medial rails 28. Similarly, as seen in FIG. 9, the rear wheel assembly 50 includes two wheels 60 rotatably supported on axles 62 spanning between flanges 64, 66 which extend from the medial rails 28 and post 34.

The structure of the bulk fluid storage container 10, and in particular the frame assembly 12 will support the weight of another filled bulk fluid storage container in a stacked relationship as illustrated in FIG. 8. In a proper stacked position, the lateral guides 20L of the lower bulk fluid storage container 10L engage the lateral rails 26U of the upper bulk fluid storage container 10U. Similarly, the medial guides 22L of the lower bulk fluid storage container 10L cooperate with the medial rails 28U of the upper bulk fluid storage container. When so positioned, the structure of the frame assembly 12L of the lower container 10L, particularly the vertical posts 34, will support the weight of the upper bulk fluid storage container 10U, even when filled with fluid.

Figure 10:
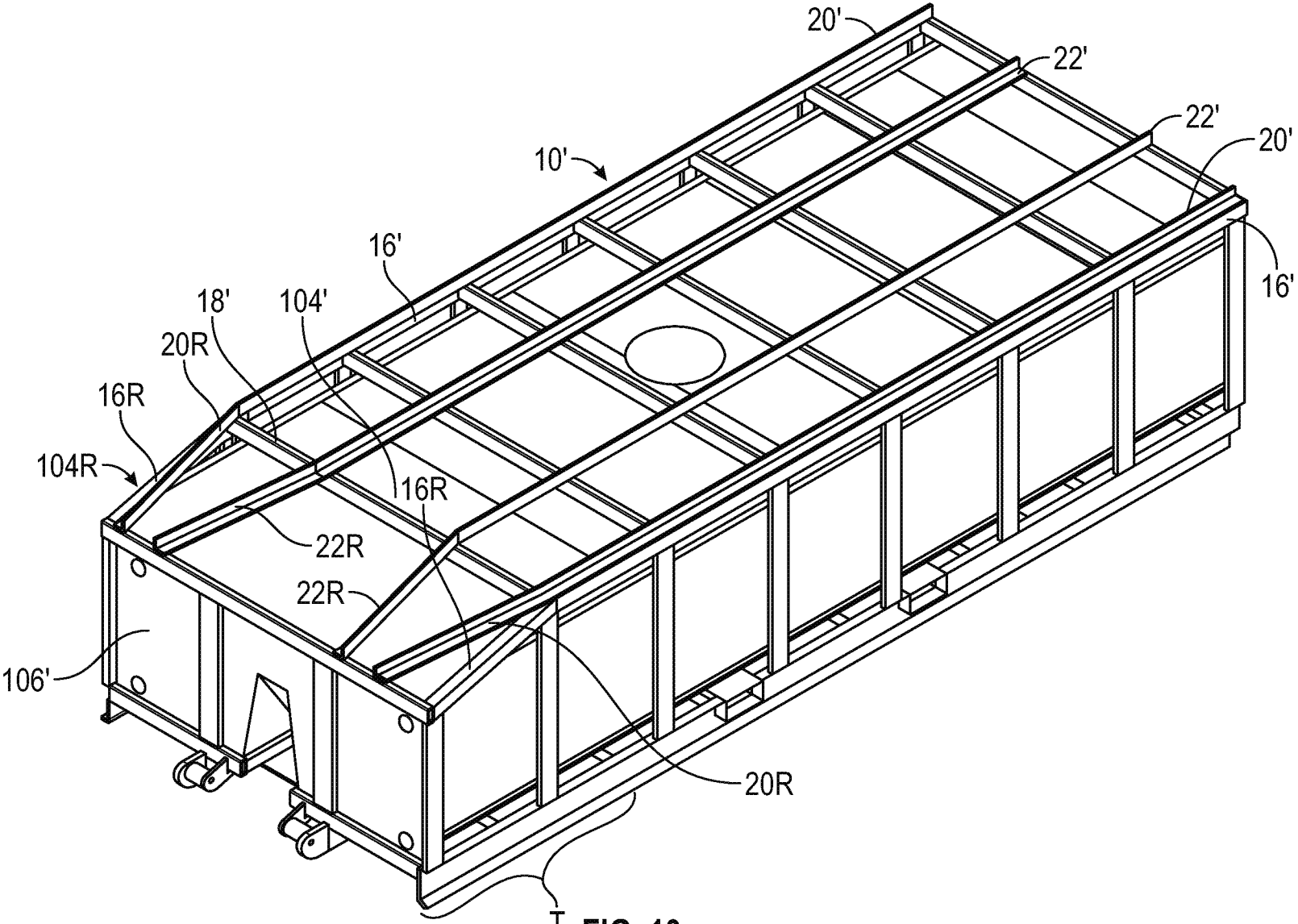
FIG. 10 is an upper front perspective view similar to FIG. 1 of another embodiment of a stackable bulk fluid storage container having a tapered front end to facilitate loading and stacking of containers.
Figure 11:
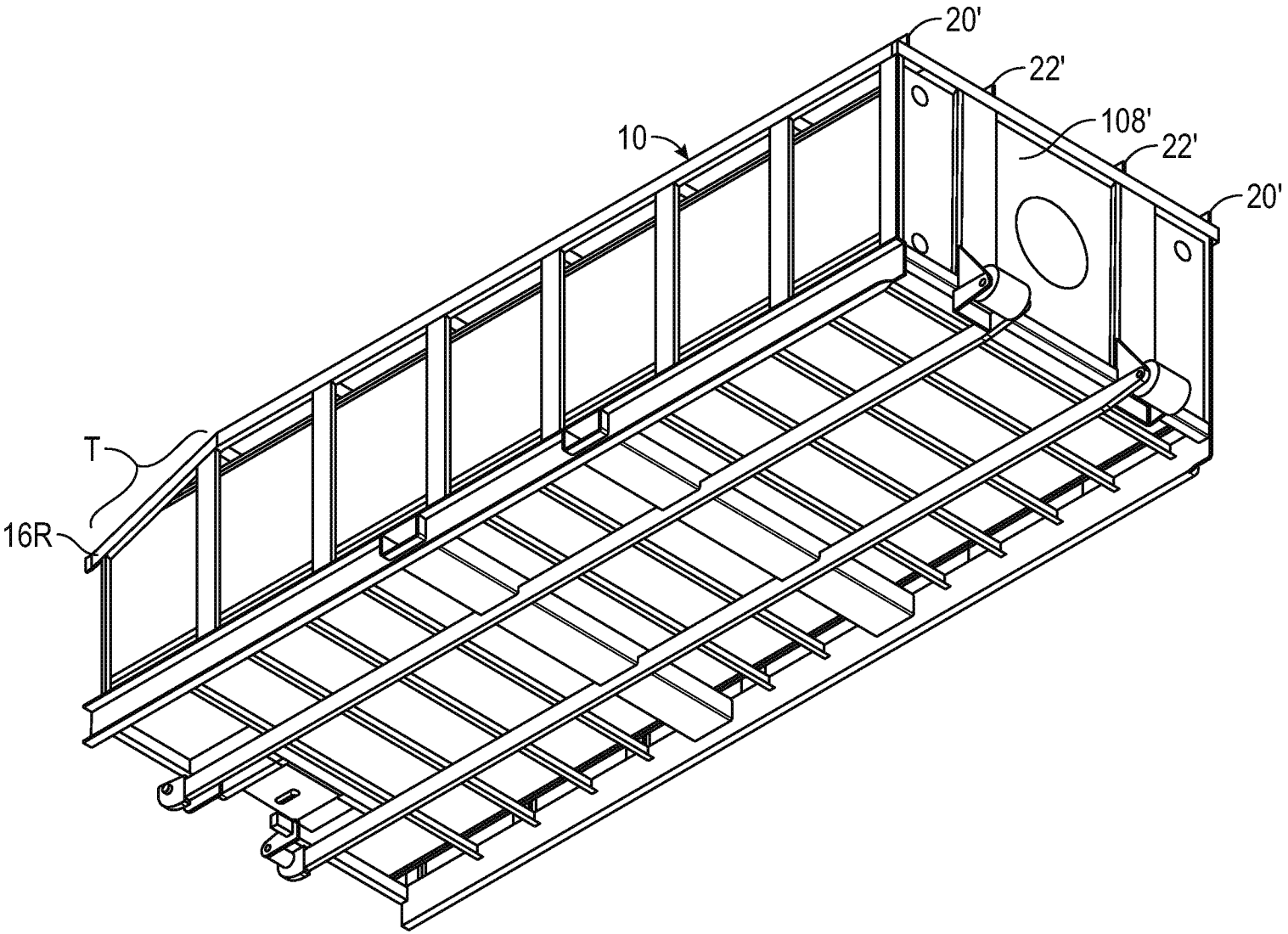
FIG. 11 is a lower rear perspective view similar to FIG. 3 of the stackable fluid bulk storage container shown in FIG. 10.

With reference now to FIGS. 10-11, another embodiment of a bulk fluid storage container 10' is illustrated which is modified from the embodiment shown in FIGS. 1-9. In particular, the bulk fluid storage container 10' includes a truncated or tapered section T in the front end region for facilitating stacking of bulk fluid storage containers. As seen in these figures, the height of the front end wall 106' is less than the height of the rear end wall 108'. To accommodate this difference a ramped section 104R extends from the front end wall 106' to the top wall 104'. An angled header 16R angles from the transverse header 18' at the front wall 106' and intersects with the longitudinal header 16'. A set of diverging channel pairs 20R, 22R extend over the ramped section 104R and align with the lateral guides 20' and medial guides 22' formed on the top wall 104'. In this way, the diverging channel pairs 20R, 22R engage and properly locate the rails 26U, 28U of the upper container 10U on to the guides 20L, 22L of the lower container 10L. In the embodiment illustrated in FIGS. 10-11, the ramped section 104R extends for approximately 15% of the overall length of the bulk fluid storage container 10'. However, one skilled in the art will understand that the extent of the ramped section may be varied based on the requirements and specification of a particular application. The other aspects of the bulk fluid storage container 10' are substantially similar to those illustrated in FIGS. 1-9 and described above, and thus need not be repeated herein.

Figure 12:
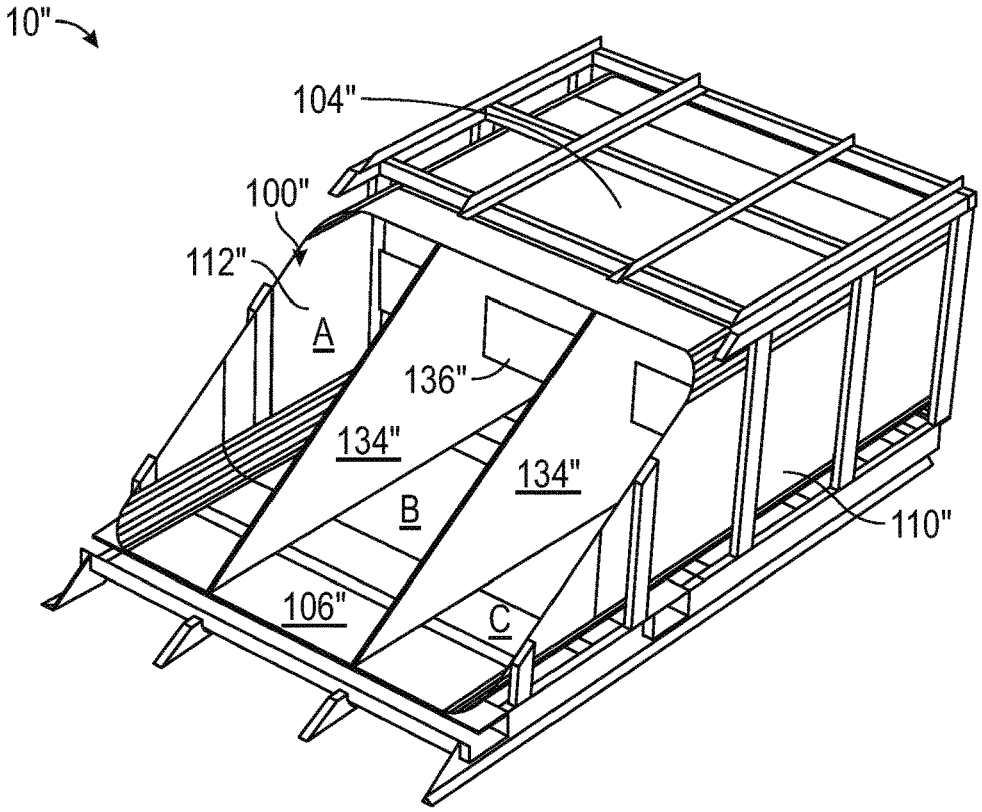
FIG. 12 a cutaway view similar to the view shown in FIG. 2 of another embodiment of a stackable bulk fluid storage container in which the interior volume is divided into separate fluid storage sections.
Figure 13:
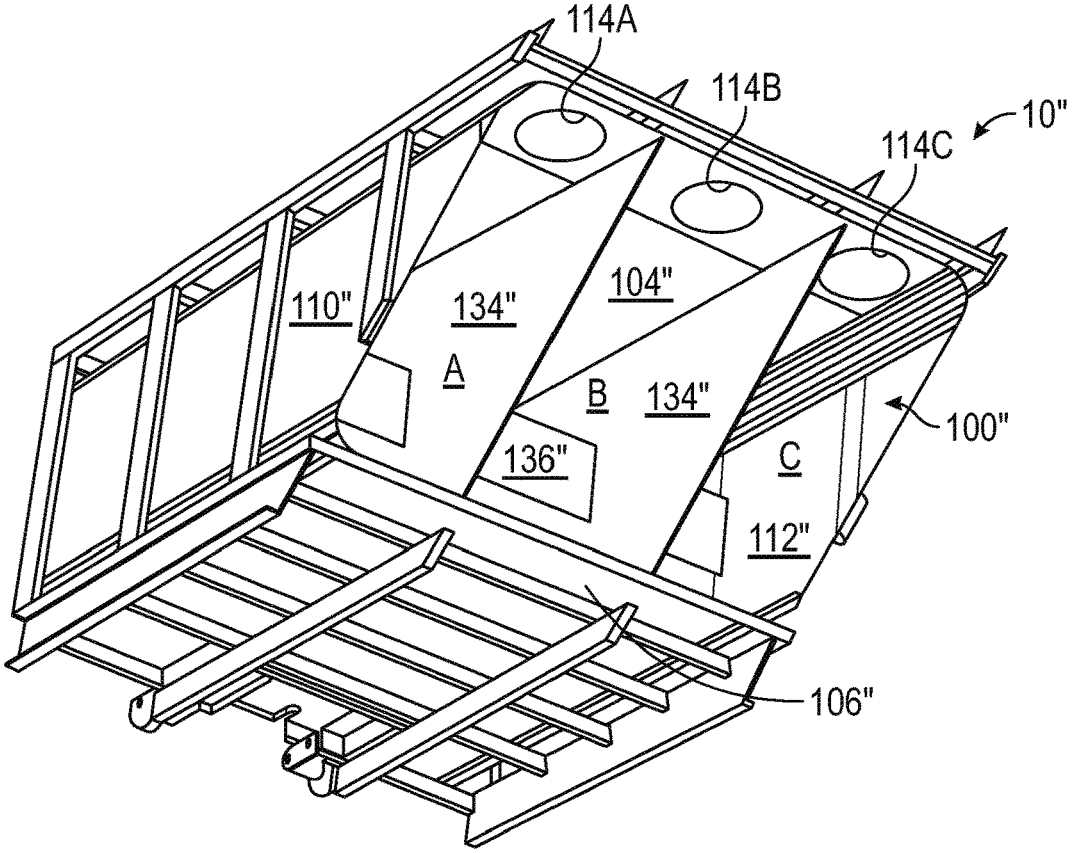
FIG. 13 is a cutaway view similar to the view shown in FIG. 4 of the storage container shown in FIG. 12.

With reference now to FIGS. 12-13, another embodiment of a bulk fluid storage container 10" is illustrated, which is modified from the embodiment shown in FIGS. 1-9. In particular, the interior volume of the fluid storage vessel 100" divided into separate sections. As seen in these figures, the first baffle plates 134" extend vertically between the top wall 104" and the bottom wall 106" to fluidly separate fluid storage vessel 100" into three distinct longitudinal volumes A, B, C. The second baffle plates 136" extend transversely between the side walls 110", 112" and first baffle plates 134" as previously described. As shown in FIG. 13, a separate fill port 114A, 114B, 114C is provided from each volume. Likewise, the front and rear end walls of the fluid storage vessel 100" are provided with upper and lower flanged ports for each volume which may be configured to provide venting and/or draining functions of the fluid storage vessel 100". In the embodiment illustrated in FIGS. 12-13, the interior volume is divided into three distinct longitudinal volumes. However, one skilled in the art will understand that the interior volume may be divided in any number of distinct longitudinal volumes, or alternately into a plurality of distinct transverse volumes based on the requirements and specification of a particular application. When providing distinct transverse volumes, the configuration of the fill ports, as well as the upper and lower flanged ports can be relocated accordingly. For example, upper and lower flanged ports may be formed in the left and right side walls. In another example, header pipes may be situated between the frame assembly and the storage vessel to provide upper and lower flanged ports at the front and rear of the bulk fluid storage container 10". In yet another example, header pipes may extend through the interior volume through the distinct transverse volumes and out of the front and rear end walls to provide upper and lower flanged ports at the front and rear of the bulk fluid storage container 10". The other aspects of the bulk fluid storage container 10' are substantially similar to those illustrated in FIGS. 1-9 and described above, and thus need not be repeated herein.

One skilled in the art should appreciate that the bulk fluid storage containers 10 described above enable the transportation, set-up and storage of fluids at a well-site or similar industrial location with one single move. In this regard, storage containers 10, which are full of fluid, may be delivered to and/or from a work site, are stackable at the work site, and can be set up and used in a vertically stacked configuration. In this way, these storage containers 10 provide improved logistics for a variety of industrial applications. In such operations, the bulk fluid storage container 10 arrives on site affixed to a roll off trailer or truck bed. The bulk fluid storage container 10L may be lowered onto the ground at its desired location. Alternately, the bulk fluid storage container 10U may be stacked on top of another bulk fluid storage container 10L already in place. The stacking process may utilize existing equipment on the roll-off trailer or truck bed such that the upper storage container 10U is unloaded directly from the roll-off trailer or truck bed and onto the top of the lower storage container 10L. In particular, the lateral guides 20L of the lower storage container 10L engage the lateral rails 26U of the upper storage container 10U. Similarly, the medial guides 22L of the lower storage container 10L cooperate with the medial rails 28U of the upper storage container. Once so situated, the storage containers 10L, 10U can be connected together using suitable piping and/or manifolds as described above. Vent pipes, pressure release valves, or floats can be used to enable the containers to maintain atmospheric pressure and not become pressurized.

Depending on the requirements of a given industrial application in which the storage containers are used, the storage container may be filled at a remote fill site and delivered to the work site in a full condition where the fluids are used or consumed. In particular, the storage container may be affixed to the roll-off trailer or truck bed, and filled at the remote fill site, such as a water station, chemical plant, etc. The bulk storage tank may be filled with a pump system, which is internal or external to the container, or fill by gravity, hydrostatic pressure, or equilibrium. The filled storage container is then taken to the work site on the roll-off trailer or truck bed and unloaded as described above.

The emptied containers may be loaded onto the roll-off trailer or truck bed and affixed thereto before it is taken away from the work site and returned to the remote fill site. Alternately, emptied containers may be situated at the work site for filling with waste fluids from the industrial application, then loaded onto the roll-off trailer or truck bed, affixed thereto and taken away from the work site in a full condition to a remote disposal site where the storage container is emptied. The emptied storage container may be returned to the work site or alternately transported to the remote fill site to be refilled. The remote fill site and the remote disposal site may constitute different locations or a single location where both the filling function and the disposal function can be carried out. As compared with conventional technology, the bulk fluid storage containers described herein can be used to transport filled storage containers over state and/or federally regulated roadway while meeting DOT restrictions. Moreover, the fluid-tight design of the storage container, as compared to conventional vacuum boxes or tanks having movable access panels, eliminates leakage during transportation of a filled storage container. In addition, the internal baffling reduces fluid sloshing and stabilizes the bulk fluid storage container when it is transported in a partially or completely filled condition.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment as contemplated herein. It should be understood that various changes may be made in the function and arrangement of elements described in an exemplary embodiment without departing from the scope of the invention as set forth in the appended claims.

What is claimed is:

1. A bulk fluid storage container comprising:

a fluid storage vessel defining a sealed fluid storage volume for storing a fluid, the fluid storage vessel having a top port for filling the fluid storage volume, one or more upper ports for venting the fluid storage volume to maintain an atmospheric pressure therein and one or more lower ports for draining the fluid storage volume; and a frame assembly including a lower frame member arranged below the fluid storage vessel, an upper frame member arranged above the fluid storage vessel and a plurality of post circumscribing the fluid storage vessel and extending between the lower frame and the upper frame member, wherein the frame assembly provides an exoskeletal structure which surrounds the fluid storage vessel and is configured to support a second bulk fluid storage container in a vertically stacked relationship, wherein the frame assembly comprises a ramped section in a front-end region extending from a front end wall to a perpendicular top wall configured to facilitate loading and stacking of the second bulk fluid storage container onto the bulk storage container in the vertically stacked relationship, wherein the frame assembly is an integral part of the bulk fluid storage container.

2. The bulk fluid storage container according to claim 1, wherein the lower frame member comprises a pair of tubular members extending transversely between a pair of longitudinal rails, wherein the tubular members are configured to receive tines of a lifting fork.

3. The bulk fluid storage container according to claim 1, wherein the frame assembly further comprises longitudinal rails arranged on the lower frame member and longitudinal guides arranged on the upper frame member, wherein the longitudinal rails on the bulk fluid storage container are configured to cooperate with the longitudinal guides on the second bulk fluid storage container for aligning the first and second storage containers in the vertically stacked relationship.

4. The bulk fluid storage container according to claim 1, wherein the frame assembly comprises a first wheel assembly extending from a first end of the lower frame member and a second wheel assembly extending from the second end of the lower frame member to facilitate loading and stacking of the second bulk fluid storage container onto the first bulk storage container in the vertically stacked relationship.

5. The bulk fluid storage container according to claim 1, wherein the frame assembly further comprises a set of diverging channels arranged on the top wall of a tapered section, a set of longitudinal guides arranged on an upper rectangular frame and aligned with the set of diverging channels and longitudinal rails arranged on a lower rectangular frame, wherein the longitudinal rails on the bulk fluid storage container are configured to cooperate with the diverging channels and the longitudinal guides on the second bulk fluid storage container for aligning the first and second storage containers in the vertically stacked relationship.

6. The bulk fluid storage container according to claim 1, further comprising a vent header configured to be coupled between at least one upper port of the bulk fluid storage container and at least one upper port of the second bulk fluid storage container stacked on top of the first bulk fluid container.

7. The bulk fluid storage container according to claim 6, wherein the vent header is configured to extend diagonally between the at least one upper port on the bulk fluid storage container and the second bulk fluid storage container.

8. The bulk fluid storage container according to claim 1, further comprising a vent pipe coupled to at least one upper port and in fluid communication with the fluid storage volume for maintaining atmospheric pressure within the fluid storage volume.

9. The bulk fluid storage container according to claim 1, wherein the frame assembly further comprises a winch coupling formed in a recess of the fluid storage vessel and a coupling plate with a catch configured to receive a hook on a winch cable.

10. The bulk fluid storage container according to claim 1, wherein the fluid storage vessel comprises an internal baffle assembly vertically oriented in the fluid storage volume for reducing fluid sloshing and stabilizing the bulk fluid storage container when it is transported in at least a partially filled condition.

11. The bulk fluid storage container according to claim 1, wherein the fluid storage vessel is divided with at least one internal baffle plate for separating the fluid storage volume into separate sections for storing diverse fluids.

12. The bulk fluid storage container according to claim 1, wherein the fluid storage container further comprises a level detection device in communication with the fluid storage volume for indicating a fluid level within the fluid storage volume.

13. A stackable bulk fluid storage container comprising:

a frame assembly including a lower frame member having longitudinal rails and an upper frame member having longitudinal guides, wherein the lower frame member is arranged in spaced relation to the upper frame member by a plurality of vertically extending posts;

a fluid storage vessel for storing a fluid including:

first and second end walls held in spaced relation by first and second side walls, a top wall and a bottom wall which defines a sealed fluid storage volume;

a baffle assembly including a plurality of baffle plates disposed in a space relationship in the fluid storage volume;

a fill port disposed in an upper region of the fluid storage vessel and in fluid communication with the fluid storage volume for filling the fluid storage volume;

a first port formed through one of the first and second end walls in an upper region of the fluid storage vessel and in fluid communication with the fluid storage volume for venting the fluid storage volume to maintain an atmospheric pressure therein; and a second port formed through one of the first and second end walls in a lower region of the fluid storage vessel and in fluid communication with the fluid storage volume for draining the fluid storage volume;

a height of the first end wall that is less than a height of the second end wall, and the fluid storage vessel further comprises a ramped section extending from the top of the first end wall to the top wall configured to facilitate loading and stacking of a second bulk fluid storage container onto the bulk storage container in a vertically stacked relationship;

wherein the frame assembly provides an exoskeletal structure surrounding the fluid storage vessel and is configured to support a second bulk fluid storage container in the vertically stacked relationship.

14. The stackable bulk fluid storage container according to claim 13, wherein the frame assembly further comprises a first wheel assembly extending from a first end of the lower frame member and a second wheel assembly extending from the second end of the lower frame member to facilitate loading and stacking of the second bulk fluid storage container onto the first bulk storage container in the vertically stacked relationship.

15. A stackable bulk fluid storage system comprising:

first and second bulk fluid storage containers, each of the first and second bulk fluid storage containers comprising:

a fluid storage vessel defining a fluid storage volume for storing a fluid, the fluid storage vessel includes a top port formed in the fluid storage vessel for filling the fluid storage volume, one or more upper ports formed in the fluid storage vessel for venting the fluid storage volume to maintain an atmospheric pressure therein and one or more lower ports formed in the fluid storage vessel for draining the fluid storage volume; and a frame assembly surrounding the fluid storage vessel to provide an exoskeletal structure, the frame assembly having a lower frame member including longitudinal rails arranged below the fluid storage vessel, an upper frame member having longitudinal guides arranged above the fluid storage vessel and a plurality of posts circumscribing the fluid storage vessel and extending between the lower frame member and the upper frame member, wherein the frame assembly of at least the first bulk storage container comprises a ramped section in a front-end region extending from a front end wall to a perpendicular top wall configured to facilitate loading and stacking of the second bulk fluid storage container onto the first bulk storage container in a vertically stacked relationship, wherein the frame assembly is an integral part of the bulk fluid storage container;

wherein the first bulk fluid storage container supports the second bulk fluid storage container in the vertically stacked relationship and the longitudinal guides on the first bulk fluid storage container cooperate with the longitudinal rails on the second bulk fluid storage container for aligning the first and second bulk fluid storage containers in the vertically stacked relationship.

16. The stackable bulk fluid storage system comprising according to claim 15, wherein the frame assembly of at least the second bulk storage container comprises a first wheel assembly extending from a first end of the lower frame member and a second wheel assembly extending from the second end of the lower frame member to facilitate loading and stacking of the second bulk fluid storage container onto the first bulk storage container in the vertically stacked relationship.

* * * * *